US005480077A

United States Patent [19]

Eng

[11] Patent Number: 5,480,077

[45] Date of Patent: Jan. 2, 1996

[54] DOUBLE THUMB STRAP FOR PISTOL HOLSTER

[76] Inventor: Christian Eng, 402 Daub Ave., Hewlett, N.Y. 11557

[21] Appl. No.: 276,454

[22] Filed: Jul. 18, 1994

[51] Int. Cl.[6] ..... F41C 33/02

[52] U.S. Cl. ..... 224/243; 224/911; D3/223

[58] Field of Search ..... 224/242, 243, 224/911, 912, 246, 232, 236, 237; D3/220, 223, 224

[56] References Cited

U.S. PATENT DOCUMENTS

| | | | |
|---|---|---|---|
| D. 227,099 | 6/1973 | Burrow | D3/222 |
| D. 356,677 | 3/1995 | Kalasautas | D3/222 |
| 3,011,687 | 12/1961 | Boyt | 224/243 |
| 4,079,870 | 3/1978 | Clark | 224/911 |
| 4,256,245 | 3/1981 | Serres | 224/911 |
| 4,303,185 | 12/1981 | Shoemaker | 224/911 |
| 4,325,505 | 4/1982 | Hillman | 224/243 |
| 4,542,841 | 9/1985 | Bianchi et al. | 224/243 |
| 4,694,980 | 9/1987 | Rogers | 224/911 |
| 4,785,983 | 11/1988 | DeSantis | 224/911 |
| 4,886,197 | 12/1989 | Bowles et al. | 224/243 |
| 5,094,376 | 3/1992 | Baruch | 224/243 |
| 5,282,559 | 2/1994 | Wisser et al. | 224/243 |

*Primary Examiner*—Henry J. Recla
*Assistant Examiner*—Gregory M. Vidovich
*Attorney, Agent, or Firm*—Galgano & Burke

[57] ABSTRACT

An automatic pistol holster includes a hollow holster body having an inner wall and an outer wall defining a lower muzzle end and an upper access opening into which, and from which, the automatic pistol may be inserted and removed, respectively, with the muzzle end of the pistol disposed adjacent the lower muzzle end and the butt end of the pistol disposed adjacent the upper access opening when the pistol is fully inserted in the holster body. At least two pair of thumb straps are provided for releasable securing the pistol in the holster. Each pair includes a first strap secured at one end to the inner wall and a second strap secured at one end to the outer wall. The first and second straps having second ends having fastening means for releasable securing the ends together. The pairs of straps are positioned to be receivable over the butt of the pistol adjacent to the hammer and neck thereof when the pistol is fully inserted into the holster body.

3 Claims, 1 Drawing Sheet

DOUBLE THUMB STRAP FOR PISTOL HOLSTER

BACKGROUND OF THE INVENTION

The present invention relates to an automatic pistol holster. More particularly, it refers to an automatic pistol holster having two releasable thumb straps which normally engage the hammer and handle portion of the pistol to prevent its inadvertent disengagement or removal from the holster.

Presently, with the accelerating increase in violent crime, federal, state and local law enforcement agencies have upgraded the firearms used by police officers. In particular, in many police departments today, the 38 special revolvers have been retired from service and instead faster, higher capacity and more reliable semi-automatic pistols have been used.

Holsters, belts and the like have been proposed for holding these weapons, but conventional holsters for these semi-automatic weapons can allow inadvertent release of the weapon from the holster such as when the police officer is in a struggle with a criminal. In particular, it is important for any holster to provide for adequate gun retention, durability, reliability, speed of access to the pistol and its withdrawal to firing position and streamline contouring to prevent accidental snagging on projections such as door handles or accidental release of the weapon.

A variety of holsters have been proposed for the use of automatic weapons (see e.g., U.S. Pat. Nos. 4,694,980, 3,252,638, 2,765,968, 2,531,170 and 4,886,197 and the Article entitled: SIGARMS QUARTERLY, Volume 5, 1993), but so far as is known by applicant, all of the currently available models typically only have a single thumb strap and snap which prevents the weapon from being removed from the holster. This single thumb snap and strap can easily become disengaged and, as a result, if not properly snapped, or if it should become inadvertently snapped open, the weapon can easily be removed or fall from the holster.

Accordingly, it is an object of the present invention to provide a novel automatic pistol holster which affords significantly improved gun retention, while at the same time affording durability and reliability, speed of access to the pistol and its withdrawal to firing position, while avoiding unintentional or inadvertent removal of the pistol from the holster.

It is a further object of the present invention to provide such a novel automatic pistol holster which is economical to fabricate, easy to use and relatively inexpensive to produce.

It is more particular object of the present invention to provide such a novel pistol holster which is specifically designed for semi-automatic pistols for use by police officers.

SUMMARY OF THE INVENTION

Certain of the foregoing and related objects are readily attained in an automatic pistol holder which includes a hollow holster body having an inner wall and an outer wall defining a lower muzzle end and an upper access opening into which, and from which, the automatic pistol may be inserted and removed, respectively, with the muzzle end of the pistol disposed adjacent the lower muzzle end and the butt end of the pistol disposed adjacent said upper access opening when said pistol is fully inserted in the holster body. Means are provided for releasably securing the automatic pistol in the holster body which includes at least two pair of thumb straps, each pair comprising a first strap secured at one end to the inner wall and a second strap secured at one end to the outer wall, the first and second straps having second ends having fastening means for releasable securing the second ends together. The pairs of the straps are positioned to be receivable over the butt of the pistol adjacent to the hammer and neck thereof when said pistol is fully inserted into said holster body.

Preferably, the fastening means comprises snap fasteners and the holster and straps are made from leather.

BRIEF DESCRIPTION OF THE DRAWING

These and other objects and advantages of the present invention will become apparent from the following description of the accompanying drawing, which discloses one embodiment of the present invention. It is to be understood that the drawing is to be used for the purpose of illustration only and not as a definition of the invention.

In the drawing, wherein similar reference characters denote similar elements throughout the several views.

DETAILED DESCRIPTION OF THE PREFERRED EMBODIMENTS

Figure 1:
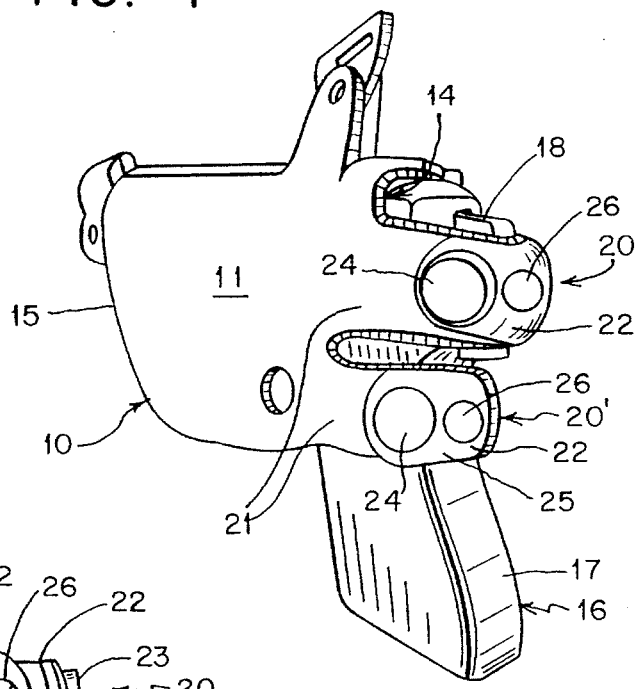
FIG. 1 is a rear perspective view of a novel automatic pistol holster embodying the present invention, further showing an automatic pistol received therein.
Figure 3:
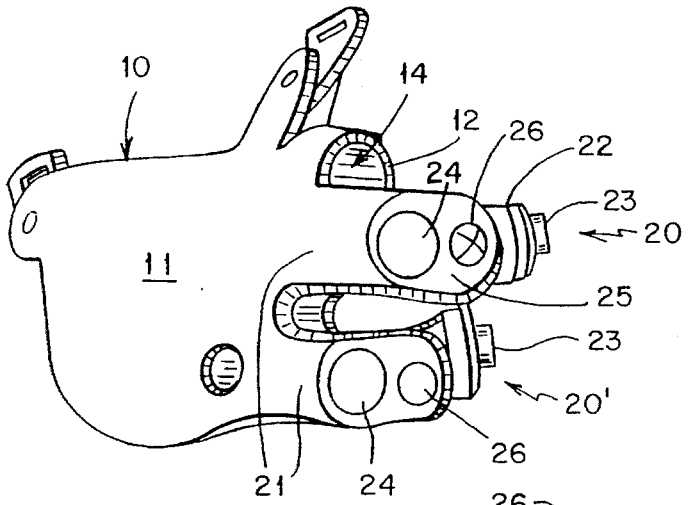
FIG. 3 is a perspective view of the holster similar to that shown in FIG. 1 but without the pistol and with the thumb snaps in an open or release position.
Figure 2:
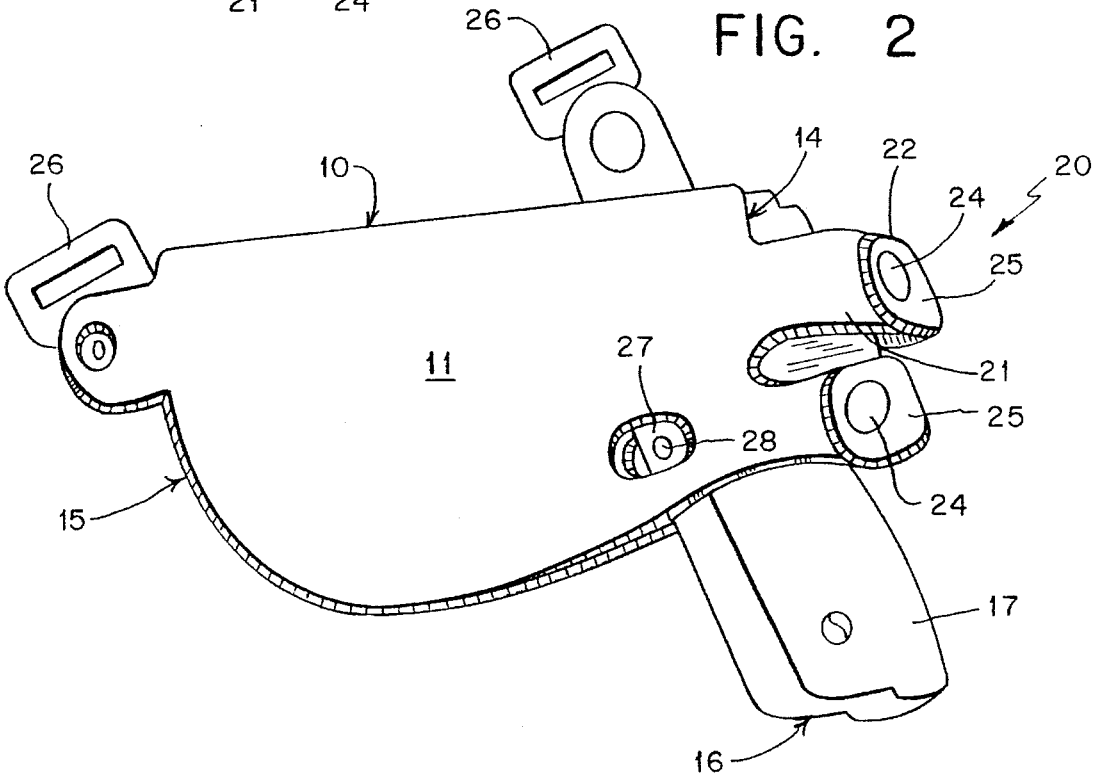
FIG. 2 is a side perspective view of the automatic pistol and holder shown in FIG. 1.

Referring now in detail to the drawing, therein illustrated is a novel automatic pistol holster embodying the present invention which, as shown in FIGS. 1–3, includes a preferably leather holster body 10 having an inner wall 11 and an outer wall 12 (see FIG. 2) defining an upper or rear access opening 14 and a forward or lower nozzle end 15. The pistol generally designated 16 can be inserted into the holster body 10 via its open rear access opening 14, muzzle end first, such that the muzzle end thereof will be disposed adjacent the forward muzzle end 15 and the butt end and handle 17 of the pistol 16 will be disposed adjacent the rear access opening 14 when the pistol 16 is fully inserted into the holster body 10.

Strap means are provided for releasably securing the automatic pistol 16 in the holster body 10. In particular, the holster 10 includes two pairs of straps generally designated 20, 20' each of which includes a first strap 21 secured at one end to the inner wall 11 and a second strap 22 secured at one end to the outer wall 12. The first and second straps 21, 22 each have second free ends provided with cooperating male-female snap fasteners 23, 24, respectively. The second free ends of the first straps 21 are preferably provided with a double thick layer via an oval shaped tab 25 affixed thereto via a rivet 26. This allows for easier grasping by the user when attempting to snap or unsnap the thumb straps 20, 20'.

As can be seen in FIGS. 1 and 3, the pairs of straps 20 are positioned such that the upper straps 20, 20' are disposed adjacent to or over the hammer 18 of the pistol 16 and the second or lower straps 20' are positioned such that they are disposed over the neck of the butt of the handle 17 of the pistol 16, just below the hammer. As can be appreciated, once the pistol 16 is inserted into the holster body 10, the thumb straps 20, 20' would be snap fastened together via snaps 23, 24 to provide a secure amounting of the pistol 16 in the pistol holder 10. If for any reason one of the pair of straps 20, 20' became undone (e.g. through either inadvertence or rubbing against surface, etc.), the other pair of straps would still serve to hold the pistol 16 in place thereby preventing disengagement and dislodgement of the pistol and possible inadvertent and harmful discharge thereof.

As seen best in FIG. 2, the holster is also provided with a pair of slotted buckles 26 by which the holster body 10 may be attached to a shoulder strap, belt or the like. Of course the positioning of the same and the number employed can be varied to suit the particular application desired. In addition to the foregoing, the shoulder holster is provided with an opening 27 to allow for access to the button release 28 of the automatic pistol 16.

Various modifications can be made as will be apparent to those skilled in the art. For example, although the holsters will be preferably made from leather, other materials can of course be used. Moreover, its shape and design can be modified to suit a particular type of automatic pistol. In addition, while the snap fasteners are preferably employed due to their ease of use, other quick release fastening means could also be employed.

Accordingly, while only one embodiment of the present invention has been shown and described, it is to be understood that many changes and modifications may be made thereunto without departing from the spirit and scope of the invention as disclosed herein.

What is claimed is:

1. An automatic pistol holster comprising a hollow holster body having an inner wall and an outer wall defining a front muzzle end and a rear access opening into which, and from which, an automatic pistol having a muzzle end and a butt end, the latter of which has a hammer and a neck adjacent to said hammer is adapted to be inserted and removed, respectively, with the muzzle end of the pistol disposed adjacent to said front muzzle end and the butt end of the pistol disposed adjacent to said rear access opening when said pistol is fully inserted in said holster body; and means for releasably securing the pistol in said holster body, said means including at least two pair of thumb straps, each pair comprising a first strap secured at a first end to said inner wall and a second strap secured at a first end to said outer wall, said first and second straps each having second ends having cooperating fastening means for releasable securing said second ends together, one of said pairs of said straps being positioned to be receivable over the butt end of the pistol adjacent to the hammer and the other of said pairs of said straps being positioned to be receivable over the neck thereof when said pistol is fully inserted into said holster body.

2. The pistol holder according to claim 1, wherein said fastening means comprises male-female snap fasteners.

3. The pistol holder according to claim 1, wherein said holster and straps are made from leather.

* * * * *